US008497058B2

(12) United States Patent
Nakamura et al.

(10) Patent No.: US 8,497,058 B2
(45) Date of Patent: Jul. 30, 2013

(54) IMAGE FORMING METHOD AND METHOD OF RECYCLING IMAGE FORMING MATERIAL

(75) Inventors: Mitsutoshi Nakamura, Tokyo (JP); Shigenori Kouno, Tokyo (JP); Masaharu Matsubara, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 642 days.

(21) Appl. No.: 12/723,721

(22) Filed: Mar. 15, 2010

(65) Prior Publication Data

US 2010/0248130 A1 Sep. 30, 2010

(30) Foreign Application Priority Data

Mar. 24, 2009 (JP) ..... 2009-071977

(51) Int. Cl.
*G03G 21/00* (2006.01)

(52) U.S. Cl.
USPC ..... 430/124.15; 430/124.1; 430/124.13; 156/701; 156/703

(58) Field of Classification Search
USPC ..... 430/124.1, 124.15, 124.13; 156/701, 156/703
See application file for complete search history.

(56) References Cited

U.S. PATENT DOCUMENTS

| | | | | |
|---|---|---|---|---|
| 5,736,286 | A * | 4/1998 | Kaneko et al. | 430/124.15 |
| RE36,963 | E * | 11/2000 | Ando et al. | 430/124.15 |
| 6,913,860 | B2 * | 7/2005 | Mochizuki et al. | 430/124.15 |
| 8,080,358 | B2 * | 12/2011 | Murakami | 430/124.15 |
| 2009/0023090 | A1 * | 1/2009 | Fujimoto et al. | 430/124.15 |

FOREIGN PATENT DOCUMENTS

| | | | |
|---|---|---|---|
| EP | 809154 | A2 * | 11/1997 |
| JP | 09160277 | A * | 6/1997 |
| JP | 11007174 | | 1/1999 |
| JP | 2002341619 | | 11/2002 |
| JP | 2004258537 | | 9/2004 |
| JP | 2007140037 | | 6/2007 |

OTHER PUBLICATIONS

English language machine translation of JP 09-160277 (Jun. 1997).*
Japanese Industrial Standards—JIS K 2207 (1996).*

* cited by examiner

*Primary Examiner* — Christopher Rodee
(74) *Attorney, Agent, or Firm* — Lucas & Mercanti, LLP

(57) ABSTRACT

An image forming method comprising the step of: forming a toner image employing toner particles containing at least a resin on an image supporting substrate having thereon a toner holding layer via a toner image holding process to form an image print, the toner image being held in the toner holding layer in the toner image holding process, wherein at least the toner particles or the image supporting substrate is separated from the image print via a separation process; and at least the separated toner particles or the separated image supporting substrate is recyclable as an image forming material.

9 Claims, 3 Drawing Sheets

IMAGE FORMING METHOD AND METHOD OF RECYCLING IMAGE FORMING MATERIAL

This application is based on Japanese Patent Application No. 2009-071977 filed on Mar. 24, 2009 in Japanese Patent Office, the entire content of which is hereby incorporated by reference.

FIELD OF THE INVENTION

The present invention relates to an image forming method in which obtained image print can be separated into toner particles and an image supporting substrate, which can be recycled as image forming materials, and to a method of recycling an image forming material.

BACKGROUND OF THE INVENTION

In view of preventing global warning, energy saving has been considered recently in varieties of fields. Also, in the field of the image forming method via electrophotography, a method to save energy in the fixing process by fixing an image only by pressing without heating (for example, refer to Patent Document 1) or a method to recycle the image supporting substrate (for example, refer to Patent Document 2) has been proposed.

However, in these methods, since toner particles are transformed irreversibly, there is a problem that recycling of the toner particles is difficult.

In order to solve such a problem, proposed is a method in which a concave portion is formed on the surface of an image supporting substrate, and the toner particles are electrostatically adhered to fix the image (for example, refer to Patent Documents 3).

However, when the method to form the concave portion on the surface of an image supporting substrate is applied, desorption of the toner particles from the concave portion tends to occur to cause a stain on the image, and, also, minute steps are formed on the image, whereby it is difficult to obtain a high quality image.

Thus, while energy saving has been conventionally attained by the recycling of the image forming materials, there have been only few methods which enable forming a high quality image.

Patent Documents 1 Japanese Patent Application Publication Open to Public Inspection (hereafter referred to as JP-A) 6-242627

Patent Documents 2 JP-A No. 2003-5435

Patent Documents 3 Japanese Patent No. 4085505

SUMMARY OF THE INVENTION

An object is of the present invention is to provide an image forming method by which a high quality image print can be obtained, while energy saving is attained.

One of the aspects to attain the above abject of the present invention is an image forming method comprising the step of: forming a toner image employing toner particles containing at least a resin on an image supporting substrate having thereon a toner holding layer via a toner image holding process to form an image print, the toner image being held in the toner holding layer in the toner image holding process, wherein at least the toner particles or the image supporting substrate is separated from the image print via a separation process; and at least the separated toner particles or the separated image supporting substrate is recyclable as an image forming material.

DESCRIPTION OF THE PREFERRED EMBODIMENTS

Figure 1A:
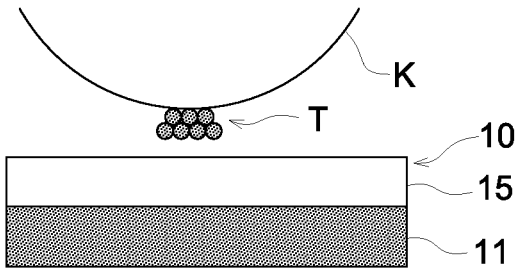
FIG. 1*a* is a schematic illustration explaining an image forming method according to a first embodiment of the present invention illustrating a state in which a toner image is formed on a photoreceptor.

The image forming method of the present invention is characterized in that, an image print is obtained via a toner image holding process in which a toner image formed by a toner containing at least a resin is held in a toner holding layer provided on an image supporting substrate;

at least toner particles or an image supporting substrate is separated from the image print via a separation process; and at least the toner particles or the image supporting substrate can be recycled as an image forming material.

In the present invention, the above image forming material is preferably used in an image forming method in which an image print is obtained via a toner image holding process in which a toner image formed by a toner containing at least a resin is held in a toner holding layer provided on an image supporting substrate.

Further, in the present invention, the above separation process can be conducted, via a dissolution treatment of an image print; or via a dissolution treatment of a toner holding layer holding a toner image, after the image print is separated into an image supporting substrate and a image holding layer holding the toner image.

The method of recycling an image forming material is characterized in that the method contains the steps of:

forming a toner image employing toner particles containing at least a resin on an image supporting substrate having thereon a toner holding layer via a toner image holding process to form an image print, the toner image being held in the toner holding layer in the toner image holding process, separating at least the toner particles or the image supporting substrate from the image print via a separation process; and recycling at least the separated toner particles or the separated image supporting substrate as the image forming material.

According to the image forming method of the present invention, basically, energy saving can be attained because a toner image is fixed on an image supporting substrate without heat;

the surface of the image print exhibits a high level of flatness because obtained image print has a toner holding layer and the toner image is held in the toner holding layer; whereby the difference in the height of the image portion and the non-image portion in the image print is small and, accordingly, a image print exhibiting a high quality image can be obtained; and a large energy saving effect as a whole can be obtained because toner particles and an image supporting substrate can be separated from the image print as image forming materials which are recyclable.

The image forming method of the present invention will now be described in more details.

A First Embodiment

The image forming method of the present invention is a method in which an image print is obtained via a toner image holding process in which a toner image formed by a toner containing at least a resin is held in a toner holding layer provided on an image supporting substrate (hereafter, also referred to as a "specified image forming method").

Figure 1B:
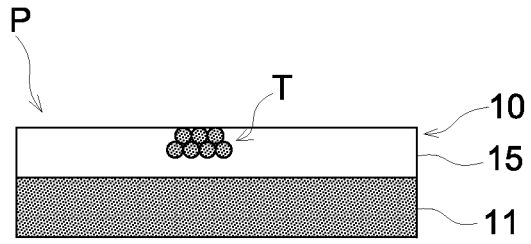
FIG. 1*b* is a schematic illustration explaining the image forming method according to the first embodiment of the present invention illustrating a state in which the toner image is held on an image carrier.

In the toner image holding process of the image forming method of this example, as shown, specifically, in FIGS. 1*a* and 1*b*, the toner image T formed by the toner particles is directly buried in the toner holding layer 15 formed on the image supporting substrate 11 according to an external force. By this toner image holding processing, fixing of the toner image T is performed and the image print P is obtained.

The external force given to bury the toner particles of the toner image T may be in the range of $1.00\times10^3$-$1.00\times10^8$ Pa.

Figure 2:
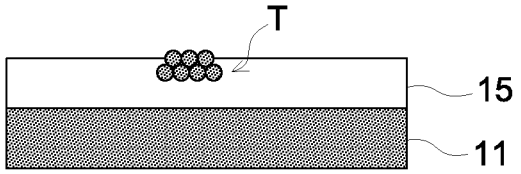
FIG. 2 is a schematic illustration showing an example of the morphology of a image print obtained by the image forming method of the present invention.

Concerning the toner image T fixed in the toner holding layer 15, it is preferable that at least 50% by volume of all the toner particles are buried as shown in FIG. 2, and it is specifically preferable that all the toner particles are buried 100% by volume as shown in FIG. 1*b*.

In the image forming method of the present invention, at least one of a toner particle and an image supporting substrate 11 is separated from the image print P via a separation process. And the toner particle and/or the image supporting substrate which are separated from the image print P can be recycled as image forming materials. The toner particle and the image supporting substrate separated from the image print P (hereafter, also referred to as a recycled toner particle and a recycled image supporting substrate, respectively) are preferably used in the abovementioned specified image forming method. A recycling system which contributes to attain energy saving can be obtained by alternately repeating the above mentioned specified image forming method and the separation process of the toner particle and/or the image supporting substrate 11.

[Separation Process]

The separation process in which the toner particle and/or the image supporting substrate are separated from the image print P obtained by the image forming method of the present invention can be conducted, for example, by immersing the image print P in a separation liquid which dissolves or swells the material constituting the toner holding layer 15, but does not dissolve the image supporting substrate.

The separation process can also be conducted by, after separating the toner holding layer 15 holding the toner image T from the image print P, by immersing the toner holding layer 15 in a separation liquid which dissolves or swells the material constituting the toner holding layer 15, but does not dissolve the toner particle.

[Separation Liquid]

In the case when the material constituting the toner holding layer 15 can be dissolved or swelled in water, examples of a separation liquid for separation of the toner particles from the image print P for recycling include: water, methyl alcohol, ethyl alcohol, ethylene glycol, propylene glycol, polyethylene glycols, glycerin, and a mixture thereof. In the case when the material constituting the toner holding layer 15 can be dissolved or swelled in an organic solvent or in an oil, examples of a separation liquid include: toluene, xylene, benzene, carbon tetrachloride, methylene chloride, 1,2-dichloroethane, 1,1,2-trichloroethane, trichloroethylene, chloroform, monochlorobenzene, dichloro ethylidene, methyl acetate, ethylacetate, methyl ethyl ketone, methyl isobutyl ketone, dimethyl-silicone oil, methylphenyl-silicone oil, methyl hydrogen-silicone oil, amino modified silicone oil and commercially available resolvents such as "E CLEAN 21 RG201" (produced by the KANEKO KAGAKU Ltd.), and DYNASOLVE 180, DYNASOLVE 225 and DYNASOLVE 711 (produced by DYNALOY (AR BROWN Co., Ltd.)). However, the present invention is not limited thereto.

Thus, the toner particles for recycling and the image supporting substrate for recycling which were separated in the state where they were immersed in separation liquid can be respectively recovered, for example, by using a centrifuge.

[Recycling of Toner Particles and/or Image Supporting Substrate]

The above recovered toner particles for recycling can be used in an image forming method of the next cycle by, for example, adding the decrement of the external additive mentioned later.

[Measurement of the External Additive in the Toner for Recycling]

The amount of the external additive in the toner particles for recycling can be determined, for example, with an X ray fluorescence analyzer. Specifically, X ray fluorescence analyzer "XRF-1700" (produced by SHIMADZU Corp.) is usable.

The difference between the energy to form an image print P(N) formed by using toner particles prepared from raw materials by granulation and the energy to feint an image print P(R) formed by using the recycled toner particles recovered as above substantially corresponds to the energy difference obtained by subtracting the subtotal of the energy required in the separation process and the energy to add the decrement of the external additive (hereafter, referred to as a recycling energy) from the energy required to granulate the toner particles from raw materials (hereafter, referred to as an initial production energy). A large energy saving effect can be obtained since the recycling energy is extremely smaller that the initial production energy.

[Image Carrier]

The image carrier 10 employed in the present invention contains an image supporting substrate 11 having thereon a toner holding layer 10. An appropriate material can be used as an image supporting substrate 11, for example, standard paper including from thin paper to thick paper, high-quality paper, printing paper which is coated such as art paper and coat paper, commercially available Japanese paper and post card paper, polypropylen synthetic paper, a polyethylene terephthalate (PET) film, a polyethylenenaphthalate (PEN) film, a polyimide film and cloth. Of these, preferable are those having high strength which do not lose the property even after a number of repeated recycling. Preferable examples of a image supporting substrate 11 which is subjected to a number of recycling include: standard paper having stiffness (thick paper), art paper, a polyethylene terephthalate (PET) film, a polyethylenenaphthalate (PEN) film and a polyimide film.

In the present invention, the toner holding layer 15 preferably does not show fluidity when no external force is applied, but shows fluidity only when an external force is applied. Specifically, the material may have a thixotropic nature in which, for example, the material is a gel in an ordinary state, and changes to a sol when an external force is applied. As a material which constitutes the toner holding layer 15, a material which is incompatible with the toner resin may be appropriately chosen. Specifically, a material which constitutes the toner holding layer 15 preferably has a fluidity of an extent in which the change in the shape of the toner particle caused by the external force applied to bury the toner particle in the toner holding layer is limited small (hereafter, referred to as a "specified fluidity"). The material having the specified fluidity is specifically a material which exhibits a penetration determined according to JIS K 2207, while the external force to bury the toner particles is applied, is 30 or more. For the toner holding layer 15, the higher penetration is more preferable. It is specifically preferable that the penetration of the toner holding layer 15 is 30-300. By using a toner holding layer having such specified fluidity, the toner image T formed on the photoreceptor K which is electrostatically adhered to the photoreceptor can be buried in the toner holding layer 15 while keeping the electrostatic charge.

The above penetration is defined as follows:

the depth of a needle having a prescribed shape, to which a load of 100 g is applied, entered into a test sample kept at 25° C. in 5 second is expressed by a unit of 1/10 mm to give the penetration. Namely, when the entered depth of the needle is 5 mm, the penetration is 50.

The external force which makes the toner particles buried in the toner holding layer 15 includes, for example, an electrostatic force given by an appropriate transfer device, a suppressing force by which the image carrier 10 is forced on the toner image T on the photoreceptor K, and a combination thereof. The penetration of the toner holding layer 15

A material having high affinity to the toner particles is preferably used as the material which constitutes the toner holding layer 15. As a material which constitutes the toner holding layer, preferable is a material which is reusable as an image forming material even after passed through a separation process of an image print P having the toner holding layer 15, namely, a separation process in which the toner particles and/or the image supporting substrate 11 contained in the image print P can be separated.

Examples of a material constituting the toner holding layer 15 include:

a resin, an elastomer or a rubber of such as a silicone compound, an acrylic compound, a vinyl compound, and a urethane compound;

a gel or a sol with an organic solvent or an oil of the above compounds;

an aqueous emulsion or a water soluble polymer of the above compounds; and a gel or a sol with an aqueous solvent of the above compounds.

Specifically, examples of a silicone resin include: dimethyl siloxane, diphenyl siloxane, methylvinyl siloxane, methylphenyl siloxane, fluoro siloxane, trifluoro siloxane, trifluoropropyl siloxane, chloromethyl siloxane, cyanoethyl siloxane, polyether siloxane, fluoropolyether siloxane and amino siloxane.

Examples of an acrylic resin include:

copolymers of 2-ethylhexyl acrylate and n-butyl acrylate; and copolymers of methyl acrylate, ethyl acrylate, methyl methacrylate, acrylic acid, methacrylic acid, itaconic acid, an acrylamide derivative, hydroxyethyl acrylate and glycidyl acrylate.

Examples of a vinyl resin include: polyvinyl acetate, ethylene-vinylacetate copolymer, acryl-vinyl acetate copolymer, polyvinyl acetal, polyvinyl butyral, phenol-vinyl butyral copolymer, polyvinyl pyrrolidone and polyvinylchloride.

As a urethane resin, polyurethane prepolymers obtained by reacting a polyol with a polyisocyanate are cited. Examples of a polyol include: 1,2-polybutadiene polyol, 1,4-polybutadiene polyol, poly(pentadiene.butadiene)polyol, poly(butadiene.styrene)polyol, and poly(butadiene.acrylonirile) polyol. Examples of a polyisocyanate include: diphenylmethane diisocyanate, tolylene diisocyanate, naphthalene diisocyanate, polymethylene polyphenyl isocyanate, xylylene diisocyanate, lysine diisocyanate, hexamethylene diisocyanate, isophorone diisocyanate and methylenebis(cyclohexyl isocyanate).

Examples of a water soluble polymer include: naturally occurring polymer polysaccharides such as xanthan gum, carageenan, pullulan, furcellaran, curdlan, gelatin and collagen; naturally occurring low-molecular polysaccharides such as, such as sodium alginate and calcium alginate; a polyacrylic acid; sodium polyacrylate; and a mixture of polyvinyl alcohol and a solve t such as water, methyl alcohol, ethyl alcohol, ethylene glycol, propylene glycol, polyethylene glycol and glycerin.

The thickness of the toner holding layer 15 is determined in connection with the thickness of the toner image T to be held, and is, for example, 1-500 μm.

In the image forming method of the present invention, when the toner holding layer 15 itself is adhesive even under no external force, a surface protective layer may be provided on the top of the toner holding layer 15, in view of storing nature and add-on capability. The surface protective layer may be provided by coating a material having the same composition as the composition of the material constituting the toner holding layer, followed by hardening only the coated layer by light, heat or steam; or by coating a material having different composition from the composition of the material constituting the toner holding layer. Examples of the above different composition include: organic solvent soluble resins such as a polystyrene resin, an acrylic resin, and a polyester resin; a photo curing agent; a heat curing agent; and a moisture curing agent. A sheet of, for example, polyethylene terephthalate (PET), polyethylene naphthalate (PEN), polypropylene (PP), and polystyrene (PS) may be used to cover the toner holding layer as a surface protective layer.

[Toner Particles]

The toner particles used in the image forming method of the present invention contain at least a resin, and, according to the necessity, a colorant, a charge controlling agent, magnetic particles, a release agent. The aggregate of such toner particles is referred to as a "toner" in the following description.

Toner particles before use will be described, below.

[Production Method of Toner Particles]

The method of producing such toner particles is not specifically limited, and any of a pulverizing method, an emulsion dispersion method, a suspension polymerization method, a dispersion polymerization method, an emulsion polymerization method, an emulsion polymerization aggregation method, and other well-known methods is applicable.

[Toner Resin]

When toner particles are produced by, for example, a pulverization method, or an emulsion dispersion method, varieties of well known resins are applicable as a resin constituting the toner particles, for example, vinyl resins such as a styrene resin, a (meth)acrylic resin, a styrene-(meth) acryl copolymer resin and an olefin resin; a polyester resin; a polyamide resin; a polycarbonate resin; a polyether resin; a polyvinyl acetate resin; a polysulfone resin; an epoxy resin; a polyurethane resin; and a urea resin. These resins may be used alone or in combination of two or more.

On the other hand, when toner particles are manufactured by, for example, a suspension polymerization method, a dispersion polymerization method, an emulsion polymerization method or an emulsion polymerization aggregation method, examples of a polymerizable to obtain a resin constituting the toner particles include: styrene and styrene derivatives such as styrene, o-methylstyrene, m-methylstyrene, p-methylstyrene, α-methyl styrene, p-chlorostyrene, 3,4-dichlorostyme, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene and p-n-dodecyl styrene; methacrylate derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate; acrylate derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate and phenyl acrylate; olefins such as ethylene, propylene and isobutylene; vinyl halogenides such as vinyl chloride, vinylidene chloride, vinyl bromide, vinyl fluoride and vinylidene fluoride; vinyl esters such as vinyl propionate, vinyl acetate and vinyl benzoate; vinyl ethers such as vinyl methyl ether and vinyl ethyl ether; vinyl ketones such as vinyl methyl ketone, vinyl ethyl ketone and vinyl hexyl ketone; N-vinyl compounds such as N-vinylcarbazole, N-vinyl indole and N-vinyl pyrrolidone; and vinyl compounds such as vinyl naphthalene and vinylpyridine; vinyl monomers of acryl derivatives or a methacryl derivatives such as acrylonirile, methacrylonitrile and acrylamide. These vinyl monomers may be used alone or in combination of two or more.

As a polymerizable monomer, one having an ionically dissociable group is preferably used in combination. A polymerizable monomer having an ionically dissociable group include those having a substituent such as a carboxyl group, a sulfonic acid group, and a phosphoric acid group, as a constituting group, and examples of which include: acrylic acid, methacrylic acid, maleic acid, itaconic acid, cinnamic acid, fumaric acid, maleic acid mono-alkyl ester, itaconic acid mono-alkyl ester, styrene sulfonic acid, allylsulfo succinic acid, 2-acrylamide-2-methylpropane sulfonic acid, acidphosphoxyethyl methacrylate and 3-chloro-2-acidphosphoxypropyl methacrylate.

Further, a binder resin having a cross linked structure can be obtained by using a multi-functional vinyl compounds as a polymerizable monomer, for example, divinylbenzne, ethylene glycol dimethacrylate, ethylene glycol diacrylate, diethylene glycol dimethacrylate, diethylene glycol diacrylate, triethylene glycol dimethacrylate, triethylene glycol diacrylate, neopentylglycol dimethacrylate and neopentylglycol diacrylate.

[Colorant]

In the case when the toner contains a colorant, varieties of organic or inorganic pigments of various kinds and various colors as shown below may be used. Namely, examples of a black colorant include: carbon black, copper oxide, manganese dioxide, aniline black, active carbon, nonmagnetic ferrite, magnetic ferrite and magnetite. Examples of a yellow colorant include: chrome yellow, zinc yellow, cadmium yellow, yellow iron oxide, mineral fast yellow, nickel titanium yellow, navel orange yellow, naphthol yellow S, Hansa yellow G, Hansa yellow 10G, benzidine yellow G, benzidine yellow GR, quinoline yellow lake, permanent yellow NCG and tartrazine lake. Examples of an orange pigment include: red chrome yellow, molybdenum orange, permanent orange G TR, the pyrazolone orange, vulcan orange, indathrene brilliant orange RK, benzidine orange G and indathrene brilliant orange G K. Examples of red pigment include: quinacridone, red ocher, cadmium red, minium, mercury sulfide, cadmium, permanent red 4R, lithol red, pyrazolone red, watchung Red, calcium salt, lake red C, lake red D, brilliant carmin 6B, eosine lake, rhodamine lake B, alizarin lake and brilliant carmine 3B. Examples of a purple pigment include: manganese purple, fast violet B, methyl violet lake. Examples of a blue pigment include: Prussian blue, cobalt blue, alkali blue color lake, Victoia blue lake, metal phthalocyanine blue, nonmetal phthalocyanine blue, phthalocyanine-blue partial chlorination, fast sky blue and indathrene blue BC. Examples of a green pigment include: chrome green, chrome oxide, pigment green B, mica light green lake and final yellow green G. Examples of a white pigment include: zinc white, titanium oxide, antimony white and zinc sulfide. Examples of an extender pigment include: barite powder, barium carbonate, clay, silica, white carbon, talc, alumina white, etc. are cited. These pigments may be used alone or in combination of two or more.

The addition amount of a colorant is preferably 0.5-20 mass parts, and more preferably 2-10 mass parts, in 100 mass parts of a toner resin.

[Magnetic Particle]

In the case when magnetic particles are contained in the toner particles, for example, magnetite, γ-hematite or varieties of ferrites may be used as magnetic particles. The addition amount of magnetic particles is preferably 10-500 mass parts, and more preferably 20-200 mass parts, in 100 mass parts of the toner resin.

[Charge Control Agent]

When a charge control agent is contained in the toner particles, the charge control agent is not specifically limited as far as it is possible to provide a positive or negative charge via triboelectric charging, and varieties of well known charge control agents are usable. Specifically, examples of a positive charge control agent include: nigrosine dyes such as NIGROSINE BASE EX (produced by ORIENT CHEMICAL INDUSTRIES Co., Ltd.); quaternary ammonium salts such as Quaternary ammonium salt P-51 (produced by ORIENT CHEMICAL INDUSTRIES Co., Ltd.) and COPY CHARGE PX VP435 (produced by HOECHST JAPAN Co., Ltd.); and imidazole compounds such as an alkoxyamine, an alkylamide, a molybdenate chelate pigment and PLZ1001 (produced by SHIKOKU CHEMICALS Corp.). Examples of a negative charge control agent include: metal complexes such as BONTRON® S-22 (produced by ORIENT CHEMICAL INDUSTRIES Co., Ltd.), BONTRON® S-34 (produced by ORIENT CHEMICAL INDUSTRIES Co., Ltd.), BONTRON® E-81 (produced by ORIENT CHEMICAL INDUSTRIES Co., Ltd.), BONTRON® E-84 (produced by ORIENT CHEMICAL INDUSTRIES Co., Ltd.) and SPILON BLACK TRH (produced by HODOGAYA CHEMICAL Co., Ltd.); quaternary ammonium salts such as a thioindigo pigment and COPY CHARGE NX VP434 (produced by HOECHST JAPAN Co., Ltd.); carixarene compounds such as BONTRON® E-89 (produced by ORIENT CHEMICAL INDUSTRIES Co., Ltd.); boron-containing compounds such as LR147 (produced by LAPAN CARLIT Co., Ltd.); and fluorine-containing compound such as magnesium fluoride and carbon fluoride.

In addition to the above described materials, other examples of a metal complex used as a negative charge control agent include: compounds having varieties of structures such as a oxycarboxylic acid metal complex, a dicarboxylic acid metal complex, an amino acid metal complex, a diketone metal complex, a diamine metal complex, an azo group-containing benzene-benzene derivative metal complex, and an azo group-containing benzene-naphthalene derivative metal complex. Thus, the chargeability of the toner can be improved by incorporating a charge control agent in the toner particles.

The addition amount of a charge control agent is preferably 0.01-30 mass parts, and more preferably 0.1-10 mass parts, in 100 mass parts of the toner resin.

[Release Agent]

When a release agent is contained in the toner particles, varieties of well known waxes are usable. It is preferable to use polyolefin waxes such as a low molecular weight polypropylene or polypropylene, and an oxidation type polyethylene or polypropylene.

The addition amount of a release agent is preferably 0.1-30 mass parts, and more preferably 1-10 mass parts, in 100 mass parts of the toner resin.

[Particle Diameter of Toner Particles]

The volume median diameter of the toner particles is preferably 3-8 μm. When the volume medial diameter is 3-8 μm, an excellent reproducibility of a thin-line and a high quality picture image can be obtained, as well as the consumption of toner particles can be reduced compared with when larger diameter toner particles are used.

The volume median diameter of toner particles is measured and calculated using a measurement device of "COULTER MULTISIZER 3 (produced by BECKMAN COULTER, Inc.) connected with a data processing computer system installed with a data processing software "SOFTWARE V3.51" (produced by BECKMAN COULTER, Inc.). Specifically, 0.02 g of the toner is added in 20 ml of a surfactant solution (a surfactant solution prepared, for example, via ten-fold dilution of a neutral detergent containing a surfactant composition with purified water in order to disperse the toner particles), followed by being wetted and then subjected to ultrasonic dispersion for 1 minute to prepare a toner particles dispersion. The toner particles dispersion is injected into a beaker set on the sample stand, containing "ISOTON II" (produced by BECKMAN COULTER, Inc.), using a pipette until the concentration indicated by the measurement device reaches 8%. This concentration makes it possible to obtain reproducible measurement values. Then, a measured particle count number and an aperture diameter are adjusted to 25000 and 50 μm, respectively, in the measurement device, and a frequency value is calculated by dividing a measurement range of 1-30 μm into 256 parts. The particle diameter at the 50% point from the higher side of the volume accumulation fraction is designated as the volume median diameter.

[Average Circularity of Toner Particles]

The average circularity defined by the following Scheme (S) of the toner particles described so far is preferably 0.700 to 1.000, and more preferably, of 0.850 to 1.000.

Average circularity=(circumferential length of a circle having the same projective area as that of a particle image)/(circumferential length of the projective particle image) Scheme (2):

[External Additive]

The above described toner particles themselves can constitute the toner according to the present invention. However, to improve fluidity, chargeability, and cleaning properties, the toner particles may be added with an external additive, for example, a fluidizer which is so-called a post-treatment agent, or a cleaning aid, to form the toner.

The post-treatment agent includes, for example, inorganic oxide particles such as silica particles, alumina particles, or titanium oxide particles; inorganic-stearate particles such as aluminum stearate particles or zinc stearate particles; or inorganic titanate particles such as strontium titanate or zinc titanate. These can be used alone or in combination of at least 2 types.

These inorganic particles are preferably subjected to surface treatment with a silane coupling agent, a titanium coupling agent, a higher fatty acid, or silicone oil to enhance heat-resistant storage stability and environmental stability.

The total addition amount of these various external additives is 0.05-5 mass parts, preferably 0.1-3 mass parts in 100 mass parts of the toner. Further, various appropriate external additives may be used in combination.

[Developer]

The toner according to the present invention may be used as a magnetic or non-magnetic single-component toner or a two-component toner by mixing with carriers. When the toner is used as a single-component developer, magnetic particles of a diameter of 0.1-0.5 μm are incorporated in a non-magnetic single-component developer or in a toner, both of which are usable. When the toner is used as a two-component toner, it is possible to use, as a carrier, magnetic particles conventionally known in the art, including metals such as iron, ferrite, or magnetite, as well as alloys of the above metals with metals such as aluminum or lead, but ferrite particles are specifically preferable. Further, it is also possible to use, as the carrier, coated carriers in which the surface of magnetic particles is coated with a coating agent such as a resin; or binder-dispersed carriers composed of magnetic particles dispersed in a binder resin.

According to the above image forming method, basically, energy saving can be attained because a toner image T is fixed on an image supporting substrate 11 without heat;

the surface of the image print P exhibits a high level of flatness because obtained image print P has a toner holding layer 15 and the toner image T is held in the toner holding layer 15; whereby the difference in the height of the image portion and the non-image portion in the image print P is small and, accordingly, a image print P exhibiting a high quality image can be obtained; and a large energy saving effect as a whole can be obtained because toner particles and an image supporting substrate 11 can be separated as image forming materials which can be recycled from the image print P.

A Second Embodiment

Figure 3A:
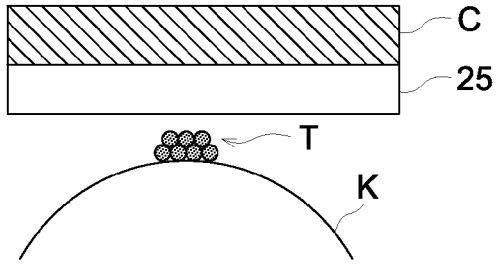
FIG. 3*a* is a schematic illustration explaining an image forming method according to a second embodiment of the present invention illustrating a state in which a toner image is formed on a photoreceptor.
Figure 3B:
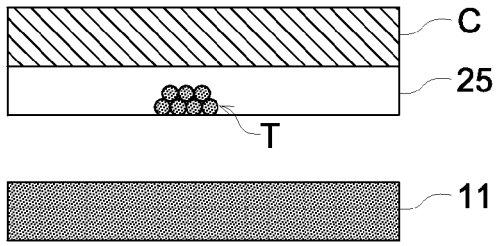
FIG. 3*b* is a schematic illustration explaining the image forming method according to the second embodiment of the present invention illustrating a state in which the toner holding layer is carried on an intermediate transfer material.
Figure 3C:
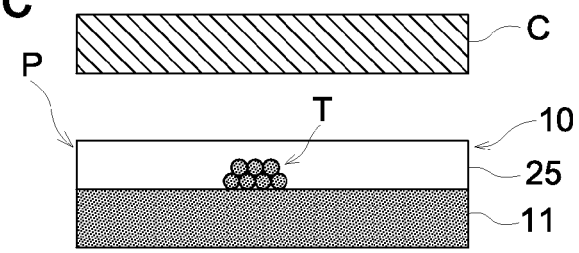
FIG. 3*c* is a schematic illustration explaining the image forming method according to the first embodiment of the present invention illustrating a state in which the toner image is held on an image carrier.

A second embodiment according to the image forming method of the present invention has the same factors as those of the first embodiment except that, the toner image T is fixed by, after the toner particles are buried, with an external force, in the toner holding layer 25 laminated on the intermediate transfer material C, as shown in FIGS. 3*a*-3*c*, in the toner holding process, laminating the toner holding layer 25 holding the toner image T on the image supporting substrate 11.

According to the image forming method described above, the same effect as the image forming method of the first embodiment can be obtained.

Thus, the embodiments of the present invention have been specifically described, however, the embodiment of the present invention is not limited to the above-mentioned examples, and various alternation may be added.

Figure 4A:
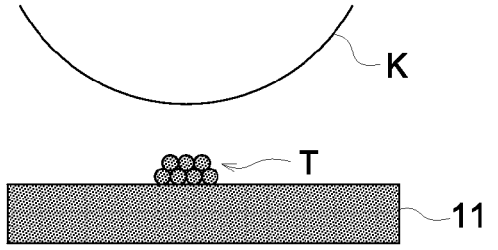
FIG. 4*a* is a schematic illustration explaining a modified image forming method according to the present invention illustrating a state in which a toner image is formed on an image supporting substrate.
Figure 4B:
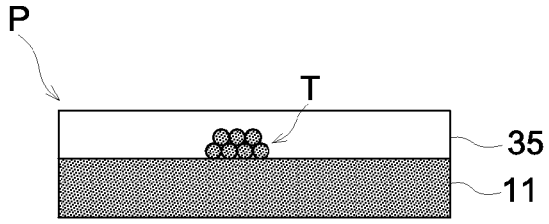
FIG. 4*b* is a schematic illustration explaining the modified image forming method according to the present invention illustrating a state in which the toner image is held on the image supporting substrate.

For example, as shown in FIGS. 4*a* and 4*b*, the toner holding process may contain the steps of: transferring the toner image T formed on the photoreceptor K on an image supporting substrate 11; providing a filler which functions as a toner holding layer 35 when solidified on the image supporting substrate 11 on which the toner image T is formed; and solidifying the filler to hold the toner image T.

Figure 5A:
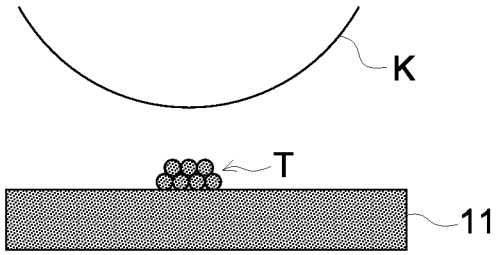
FIG. 5*a* is a schematic illustration explaining another modified image forming method according to the present invention illustrating a state in which a toner image is formed on an image supporting substrate.
Figure 5B:
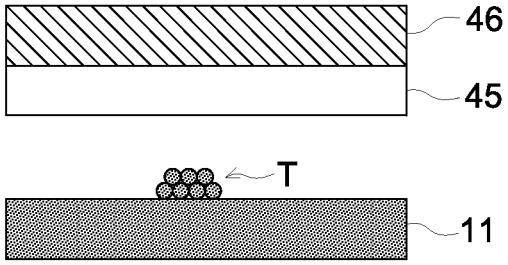
FIG. 5*b* is a schematic illustration explaining the modified image forming method according to the present invention illustrating a state in which a surface protective sheet having a toner holding layer is laminated on the image supporting substrate.
Figure 5C:
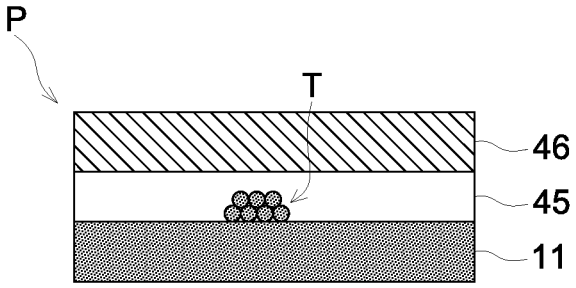
FIG. 5*c* is a schematic illustration explaining the modified image forming method according to the present invention illustrating a state in which the toner image is held in the image carrier.

Further, for example, as shown in FIGS. 5*a*-5*c*, the toner holding process may contain the steps of transferring the toner image T electrostatically formed with toner particles on the photoreceptor K on an image supporting substrate 11; and laminating a surface protective material 46 on a rear surface of which a toner holding layer 45 is formed with the toner image T so that the toner image T and the toner holding layer 45 contact with each other to bury the toner image Tin the toner holding layer 45.

EXAMPLES

Specific examples of the present invention will be described below, however, the present invention is not limited thereto.

[Synthetic Example of Toner Particles 1]

(1) Preparation of Colorant Particle Dispersion Liquid

In a surfactant solution prepared by dissolving 2.5 parts by mass of sodium n-dodecylsulfate in 1600 parts by mass of deionized water, 400 parts by mass of a quinacridone pigment was added gradually while stirring the surfactant solution, followed by an dispersion treatment using a sand grinder produced by AMEX Co., Ltd. to obtain a colorant particle dispersion [1] in which colorant particles having a volume average particle diameter of 215 nm were dispersed. The volume average particle diameter of the particles in the dispersion was determined by UPA-150 produced by NIKKISO Co., Ltd.

(2) Preparation of Toner

To a vessel having a stirrer, a heat-cooling device, a nitrogen introducing device and a raw material-assisting agent charging device, a surfactant solution prepared by dissolving 4 parts by mass of sodium dodecylsulfonate in 2,800 parts by mass of deionized water was charged and the internal temperature was raised to 80° C. while stirring at a stirring rate of 200 rpm under a nitrogen current. To the solution, a solution prepared by dissolving 10 parts by mass of potassium persulfate in 400 parts by mass of deionized water was added and then a monomer mixture composed of 530 parts by mass of styrene, 200 parts by mass of n-butyl acrylate, 70 parts by mass of acrylic acid and 16 parts by mass of n-octylmercaptan was dropped spending 90 minutes and polymerized by keeping the temperature for 120 minutes to prepare a latex (Lx1).

To a monomer liquid composed of 116 parts by mass of styrene, 47 parts by mass of n-butyl acrylate and 2 parts by weigh of n-octylmercaptan, 70 parts by mass of polyethylene wax was added and dissolved at 80° C. to prepare a monomer solution. On the other hand, a surfactant solution prepared by dissolving 3 parts by mass of sodium dodecylsulfonate in 700 parts by mass of deionized water was heated to 80° C. and mixed with the above monomer solution. And then, the mixture was treated for 30 minutes by a mechanical dispersing machine CLEARMIX, produced by M TECH Co., Ltd., to prepare an emulsified dispersion [1].

To a vessel having a stirrer, a heat-cooling device, a nitrogen introducing device and a raw material-assisting agent charging device, 1,700 parts by mass of deionized water and 160 parts by mass of the foregoing latex [Lx1] were charged and the internal temperature was raised by 80° C. while stirring at a stirring rate of 200 rpm under a nitrogen atmosphere. To the resultant liquid, the foregoing emulsified dispersion and a solution prepared by dissolving 6 parts by mass of potassium persulfate in 240 parts by mass of deionized water were added and polymerized for 2 hours to obtain a latex [Lx2].

To the latex [Lx2], a solution prepared by dissolving 5 parts by mass of potassium persulfate in 220 parts by mass deionized water was added, and a monomer mixture liquid composed of 338 parts by mass of styrene, 110 parts by mass of n-butyl acrylate and 7 parts by mass of n-octylmercaptan was dropped spending 90 minutes and polymerized by holding the temperature for 120 minutes to obtain a latex [Lx3] having a volume average particle diameter of 156 nm.

Further, to a vessel having a stirrer, a heat-cooling device, a nitrogen introducing device and a raw material-assisting agent charging device, 1,300 parts by mass of deionized water, 790 parts by mass of the foregoing latex [Lx3] and 163 parts by mass of the foregoing colorant particles dispersion [1] were charged and the pH value of the liquid was adjusted to 10 by adding a 5 M sodium hydroxide solution, while stirring at a stirring rate of 200 rpm. To the resultant liquid, a solution prepared by dissolving 27 parts by mass of magnesium chloride 6 hydrate in 27 parts by mass of deionized water was added and the temperature of the liquid was raised to 86° C. to continue the grain growing reaction while keeping the temperature. At the moment when the volume average particle diameter of the associated particles reached at 6.6 μm, a solution prepared by dissolving 67 parts by mass of sodium chloride in 270 parts by mass of deionized water was added to sop the growth of the particles, and then the particles were subjected to a treatment of making sphere shape having an average circularity of 0.94, while continuing heating. The liquid was then cooled and repeatedly subjected to filtration and washing, followed by drying, to obtain toner mother particles [1] having a volume average particle diameter of 6.4 μm.

To 100 parts by mass of the toner mother particle [1], 0.5% by mass of silica particle H-2000, manufactured by Hoechst Japan Ltd., and 1% by mass of titanium dioxide particle T-805, manufactured by Nihon Aerosil Co., Ltd. were added and treated by HENSCHEL MIXER (produced by MITSUI MINING Co., Ltd.) to obtain toner [I] employing toner mother particles [1].

In the foregoing processes, the volume average particle diameters of the particles in the latex [Lx3] and toner mother particles [1] were determined by COULTER MULTISIZER, manufactured by BECKMAN COULTER Inc., and the average circularity of the toner particles was measured by a flow type particle image analyzing apparatus FPIA-2000, manufactured by SYSMEX Corp. With respect to the toner mother particles [1], the shape and diameter were not changed by the addition of silica particles and titanium dioxide particles, which is the same as below.

[Synthetic Example of Toner Particles 2]

Colorant dispersion [1] was prepared by charging 10.0 g of copper phthalocyanine pigment, 90.0 g of styrene, 10.0 g of methyl methacrylates, and 260 g of 1 mmϕ) glass beads into a polymer bottle, dispersin the mixture for 4 hours using a paint shaker, and removing the glass beads by filtering with a mesh.

Subsequently, 40.0 g of divinylbenzne and 1.6 g of azobisisobutyronitrile were supplied to 66.0 g of the colorant dispersion [1], and agitated for 15 minutes with a rate of 200 rpm using a Three-One Motor produced by Shinto Science Co., Ltd. to obtain a colorant dispersion [2].

Next, an aqueous dispersion [3] was prepared by 2.5 g of sodium dodecylsulfonate and 100.0 g of polyvinyl alcohol were dissolved in 500.0 g of deionized water.

Subsequently, an O/W emulsion [4] was prepared by charging the colorant dispersion [2] and the aqueous dispersion [3] into a round bottom flask, and agitating for 20 minutes with a stirring rate of 6000 rpm by a TK homomixer produced by PRIMIX Corp.

Further, to a vessel having a stirrer, a heat-cooling device, a nitrogen introducing device and a raw material-assisting agent charging device, the O/W emulsion [4] was charged and the internal temperature was raised to 70° C., while stirring at a stirring rate of 200 rpm under a nitrogen flow. The polymerization was conducted for 4 hours to obtain a particle dispersion. The particle dispersion was repeatedly filtered and washed with water 5 times, whereby a toner mother particle [2] having a volume average particle diameter of 6.2 μm and an average circularity of 0.99 was obtained.

To 100 parts by mass of the toner mother particle [2], 0.5% by mass of silica particle H-2000, manufactured by Hoechst Japan Ltd., and 1% by mass of titanium dioxide particle T-805, manufactured by Nihon Aerosil Co., Ltd. were added and treated by HENSCHEL MIXER (produced by MITSUI MINING Co., Ltd.) to obtain toner [2] employing the toner mother particles [2].

[Synthetic Example of Toner Particles 3]

A mixture of 100 mass parts of a polyester resin (Tg: 61° C., Mn=4,200, Mw/Mn=5.5), 6 mass parts of copper phthalocyanine pigments, 5 mass parts of polyethylene wax, 2 mass parts of a charge control agent BONTRON® E-84 (produced by ORIENT CHEMICAL INDUSTRIES Co., Ltd.) was kneaded in a melt kneader, followed by pulverizing and then classifying, whereby a toner mother particle [3] having a volume average particle diameter of 7.5 μm and an average circularity of 0.78 was obtained.

To 100 parts by mass of the toner mother particle [3], 0.5% by mass of silica particle H-2000, manufactured by Hoechst Japan Ltd., and 1% by mass of titanium dioxide particle T-805, manufactured by Nihon Aerosil Co., Ltd. were added and treated by HENSCHEL MIXER (produced by MITSUI MINING Co., Ltd.) to obtain toner [3] employing the toner mother particles [3].

[Examples of Preparation of Developers 1-4]

Two component developers [1]-[3] were prepared by mixing each of toners [1]-[3] with an acryl coated silicone carrier in a mass ratio of 6:94.

A two component developer [4] was prepared by mixing the toner [1], polyvinyl alcohol particles (1 μm) and an acryl coated silicone carrier in a mass ratio of 4.5:1.5:94.

Example 1

The viscosity of a 10 mass % aqueous solution of carrageenan was lowered by stirring with a Three-One Motor produced by Shinto Science Co., Ltd., and applied on a coat paper, followed by drying until a soft gel was obtained, whereby an image carrier [1] having a thickness of 20 μm and penetration of 40 was obtained.

On this image carrier [1], a toner image was formed by "BIZHUB C 253" (produced by Konica Minolta Business Technologies, Inc.) from which the fixing device was removed, employing developer [1], and then the image carrier [1] was passed through the removed fixing device without using the heating member, followed by adhering a transparent PET film having a thickness of 5 μm on the toner holding layer, whereby an image print [1] was obtained. The external force applied by the fixing device of aforementioned BIZHUB C 253 to the image carrier [1] was $1.6\times10^5$ Pa.

When the fixing ratio on this image print [1] was calculated by measuring the fixing strength via the following mending tape exfoliating method and the cloth rubbing method, both of the fixing ratios determined by the following two methods were 80% or more, and thus the fixing of the toner image was confirmed. It was confirmed that a high fixing strength was attained since both of the fixing ratios determined by the following two methods were 80% or more.

Mending Tape Exfoliating Method:

1) measuring the absolute reflection density $D_0$ in an imaging area;

2) adhering lightly a mending tape "No. 810-3-12" (produced by SUMITOMO 3M Co., Ltd.) on the imaging area 3) rubbing 3.5 times back and forth on the mending tape at the pressure of 1 kPa;

4) exfoliating the mending tape by an angle of 180° with a force of 200 g;

5) measuring the absolute reflection density $D_1$ after exfoliating the mending tape;

6) calculating a fixing ratio based on the following formula (M), $$\text{Fixing ratio (\%)}=D_1/D_0\times100. \qquad \text{Formula (M)}$$

A reflection densitometer "RD-918" (produced by MACBETH) was used for measuring an absolute reflection density.

Cloth Rubbing Method:

1) measuring the absolute reflection density $D_0$ in an imaging area;

2) pressing a flannel cloth against an imaging area by a pressure of 1 kPa;

3) rubbing 3.5 times back and forth on the mending tape at a pressure of 1 kPa;

4) removing the flannel cloth;

5) measuring the absolute reflection density $D_2$ after removing the flannel cloth;

6) calculating a fixing ratio based on the following formula (N), $$\text{Fixing ratio (\%)}=D_2/D_0\times100 \qquad \text{Formula (N)}$$

A reflection densitometer "RD-918" (produced by MACBETH) was used for measuring an absolute reflection density.

For both the "Mending tape exfoliating method" and the "Cloth rubbing method", the fixing strength was evaluated according to the following criteria:

A the fixing ratio is 80% or more;

B the fixing ratio is less than 80%.

After exfoliating the transparent PET film of the topmost part of the image print [1], it was immersed in a surfactant solution prepared by dissolving 2.0 mass parts of sodium dodecyl sulfonate in 1000 mass parts of deionized water, and ultrasound was applied to the image print [1]. Subsequently, the toner particles, the external additive, and the carrageenan aqueous solution were separated with a centrifuge, and the toner particles, the external additive and carrageenan after removing water were recovered. The recovery of the toner particles from the image print [1] was 98% in mass conversion.

The amounts of external additives in the recovered toner particles were measured by determining the amounts of silica particles and titanium oxide particles using an X ray fluorescence analyzer. The residual amounts of the silica particles and the titanium dioxide particles were 63% and 78%, respectively, based on the initial amounts. The recycling developer [1-2] containing the recycling toner [1-2] using the recycling toner particles [1-2] was obtained by adding the external additive of the insufficiency from initial toner particles, and mixing with a HENSCHEL MIXER (produced by MITSUI MINING Co., Ltd.).

An image print [1-2] was obtained in the same manner as described for the image print [1] employing the recycling developer [1-2]. No difference in the image quality was observed in a visual observation between the initial image print [1] and the image print [1-2].

Example 2

After applying a silicone gel SE1891H (produced by Dow Corning Toray Co., Ltd.) using a bar coater on a PET sheet [A] processed with a fluorine-containing coating liquid, the silicone gel was hardened by standing the PET sheet to a sunny location, whereby an image carrier provided with a soft toner holding layer having a thickness of 50 μm and a penetration of 45 was obtained.

On this image carrier, a toner image was formed using BIZHUB C 253 (produced by Konica Minolta Business Technologies, Inc.) from which the fixing device was removed, employing developer [2], and then the image carrier was laminated on a white PET sheet [B]. The obtained sheet was passed through the removed fixing device without using the heating member, followed by exfoliating the PET sheet [A] to obtain an image print [1] in which a toner holding layer holding a toner image is provided on the white PET sheet [B]. The fixing ratios on this image print [2] determined via the mending tape exfoliating method and the cloth rubbing method were calculated in the same manner as described in Example 1. From the results, the fixing of the toner image and a high fixing strength of the image were confirmed.

The image print [2] was immersed in methylene chloride and ultrasound was applied to the image print [2]. Subsequently, the toner particles, the external additive, and a methyl chloride solution of the silicone gel were separated with a centrifuge, and the toner particles and the external additive were recovered. The recovery of the toner particles from the image print [2] was 97% in mass conversion.

The amounts of external additives in the recovered toner particles were measured by determining the amounts of silica particles and titanium oxide particles using an X ray fluorescence analyzer. The residual amounts of the silica particles and the titanium dioxide particles were 18% and 23%, respectively, based on the initial amounts. The recycling developer [2-2] containing the recycling toner [2-2] using the recycling toner particles [2-2] was obtained by adding the external additive of the insufficiency from initial toner particles, and mixing with a HENSCHEL MIXER (produced by MITSUI MINING Co., Ltd.).

An image print [2-2] was obtained in the same manner as described for the image print [2] according to Example 2 employing the recycling developer [2-2]. No difference in the image quality was observed in a visual observation between the initial image print [2] and the image print [2-2].

Example 3

On a white PET sheet, a toner image was formed using BIZHUB C 253 (produced by Konica Minolta Business Technologies, Inc.) from which the fixing device was removed, employing developer [2], employing the developer [2]. On the toner image, a fluorine modified silicone gel SIFEL8370 (produced by Shin-Etsu Chemical Co., Ltd.) was dropped, and then a 5 μm transparent PET film was laminated to cover the image, followed by standing the white PET sheet to a sunny location to harden the gel, whereby the image print [3] was obtained. The fixing ratios on this image print [3] determined via the mending tape exfoliating method and the cloth rubbing method were calculated in the same manner as described in Example 1. From the results, the fixing of the toner image and a high fixing strength of the image were confirmed.

After exfoliating the transparent PET film of the topmost part of the image print [3], it was immersed in chloroform, and ultrasound was applied to the image print [3]. Subsequently, the toner particles, the external additive, and a chloroform solution of the fluorine modified silicone gel were separated with a centrifuge, and the toner particles, the external additive were recovered. The recovery of the toner particles from the image print [3] was 90% in mass conversion.

The amounts of external additives in the recovered toner particles were measured by determining the amounts of the silica particles and the titanium oxide particles using an X ray fluorescence analyzer. The residual amounts of the silica particles and the titanium dioxide particles were 29% and 32%, respectively, based on the initial amounts. The recycling developer [2-3] containing the recycling toner [2-3] using the recycling toner particles [2-3] was obtained by adding the external additive of the insufficiency from initial toner particles, and mixing with a HENSCHEL MIXER (produced by MITSUI MINING Co., Ltd.).

An image print [3-2] was obtained in the same manner as described for the image print [3] employing the recycling developer [2-3]. No difference in the image quality was observed in a visual observation between the initial image print [3] and the image print [3-2].

Embodiment 4

A gelatin solution (including 20 mass % of titanium dioxide) of which pH value was adjusted to 3.0 was applied on a white PET sheet having a hydrophilized surface, and then dried until a soft gel was obtained, whereby an image carrier [4] having a thickness of 20 μm and a penetration of 45 was obtained.

On this image carrier [4], a toner image was formed using BIZHUB C 253 (produced by Konica Minolta Business Technologies, Inc.) from which the fixing device was removed, employing developer [3]. The obtained image carrier was passed through the removed fixing device without using the heating member, followed by immersing the sheet in a liquid formalin to harden the toner holding layer containing gelatin, whereby an image print [4] was obtained.

The fixing ratios on this image print [4] determined via the mending tape exfoliating method and the cloth rubbing method were calculated in the same manner as described in Example 1. From the results, the fixing of the toner image and a high fixing strength of the image were confirmed.

The image print [4] was immersed in a surfactant solution prepared by dissolving 2.0 mass parts of sodium dodecyl sulfonate in 1000 mass parts of deionized water, and ultrasound was applied to the image print [4]. Subsequently, the hardened material was removed with a mesh, the toner particles, the external additive and an aqueous gelatin solution were separated with a centrifuge, and the toner particles, the external additive and gelatin after removing water were recovered. The recovery of the toner particles from the image print [4] was 90% in mass conversion.

The amounts of external additives in the recovered toner particles were measured by determining the amounts of silica particles and titanium oxide particles using an X ray fluorescence analyzer. The residual amounts of the silica particles and the titanium dioxide particles were 59% and 71%, respectively, based on the initial amounts. The recycling developer [3-2] containing the recycling toner [3-2] using the recycling toner particles [3-2] was obtained by adding the external additive of the insufficiency from initial toner particles, and mixing with a HENSCHEL MIXER (produced by MITSUI MINING Co., Ltd.).

An image print [4-2] was obtained in the same manner as described for the image print [4] according to Example 4 employing the recycling developer [3-2]. No difference in the image quality was observed in a visual observation between the initial image print [4] and the image print [4-2].

Example 5

After applying a silicone gel SE1891H (produced by Dow Corning Toray Co., Ltd.) using a bar coater on a PET sheet [C], the silicone gel was hardened by standing the PET sheet to a sunny location, whereby a surface protective sheet [C] provided with a soft toner holding layer having a thickness of 30 μm and a penetration of 45 was obtained.

On a "J paper" produced by Konica Minolta Business Solutions, Inc., a toner image formed by BIZHUB C 253 (produced by Konica Minolta Business Technologies, Inc.) from which the fixing device was removed, employing developer [2] was transferred, and then the above PET sheet [C] was laminated. The obtained sheet was passed through the removed fixing device without using the heating member to obtain an image print [5] having a toner holding layer holding a toner image.

The fixing ratios on this image print [5] determined via the mending tape exfoliating method and the cloth rubbing method were calculated in the same manner as described in Example 1. From the results, the fixing of the toner image and a high fixing strength of the image were confirmed.

From the image print [5], the paper and the surface protective sheet [C] holding the toner image were separated. The surface protective sheet [C] was immersed in methylene chloride and ultrasound was applied to the protective sheet [C]. Subsequently, the toner particles, the external additive, and a methyl chloride solution of the silicone gel were separated with a centrifuge, and the toner particles and the external additive were recovered. The recovery of the toner particles from the image print [5] was 97% in mass conversion.

The amounts of external additives in the recovered toner particles were measured by determining the amounts of silica particles and titanium oxide particles using an X ray fluorescence analyzer. The residual amounts of the silica particles and the titanium dioxide particles were 18% and 23%, respectively, based on the initial amounts. The recycling developer [2-4] containing the recycling toner [2-4] using the recycling toner particles [2-4] was obtained by adding the external additive of the insufficiency from initial toner particles, and mixing with a HENSCHEL MIXER (produced by MITSUI MINING Co., Ltd.).

An image print [5-2] was obtained in the same manner as described for the image print [5] according to Example 5 employing the recycling developer [2-4]. No difference in the image quality was observed in a visual observation between the initial image print [5] and the image print [5-2].

Comparative Example 1

On a "J paper" produced by Konica Minolta Business Solutions, Inc., a toner image was formed by BIZHUB C 253 (produced by Konica Minolta Business Technologies, Inc.) from which the fixing device was removed, employing the developer [1]. The obtained J paper was passed through the removed fixing device with a fixing temperature of 180° C. to obtain a comparative image print [6]. The fixing ratios on the comparative image print [6] determined via the mending tape exfoliating method and the cloth rubbing method were calculated in the same manner as described in Example 1. From the results, the fixing of the toner image and a high fixing strength of the image were confirmed.

The image print [6] was immersed in water and the ultrasound was applied to the image print [6]. However, the toner particles were inseparable from the paper.

Comparative Example 2

On a "J paper" produced by Konica Minolta Business Solutions, Inc., a toner image was formed by BIZHUB C 253 (produced by Konica Minolta Business Technologies, Inc.) from which the fixing device was removed, employing the developer [4]. The obtained J paper was passed through the removed fixing device with a fixing temperature of 180° C. to obtain a comparative image print [7]. The fixing ratios on the comparative image print [7] determined via the mending tape exfoliating method and the cloth rubbing method were calculated in the same manner as described in Example 1. From the results, the fixing of the toner image and a high fixing strength of the image were confirmed.

The image print [7] was immersed in water and the ultrasound was applied to the image print [6]. It was found that the paper and the toner particles could be separated. However, the toner particles were aggregated with each other, and could not be recycled.

Comparative Example 3

Image carrier [X] was produced by cutting a toner accepting portion of a width of 100 μm and a depth of 50 μm according to the desired image on an A4 sized PET sheet having a thickness of 500 μm. In the toner accepting portion of the image carrier [X], the developer [1] was supplied to obtain a comparative image print [8]. When the fixing ratios on the comparative image print [8] were determined, the fixing ratio determined by a mending tape exfoliation method was 80%, however, in a cloth rubbing method, exfoliation of toner particles was observed and the fixing ratio was determined to be less than 80%. Thus, high fixing strength was not obtained.

By sweeping this image print [8] with a brush, the image print was separated into toner particles and the image carrier [X], whereby the toner particles and the image carrier [X] were recovered. The recovery of the toner particles from the image print object [8] was 99% in mass conversion.

The amounts of external additives in the recovered toner particles were measured by determining the amounts of silica particles and titanium oxide particles using an X ray fluorescence analyzer. The residual amounts of the silica particles and the titanium dioxide particles were 92% and 89%, respectively, based on the initial amounts. The recycling developer [1-3] containing the recycling toner [1-3] using the recycling toner particles [1-3] was obtained by adding the external additive of the insufficiency from initial toner particles, and mixing with a HENSCHEL MIXER (produced by MITSUI MINING Co., Ltd.).

An image print [8-2] was obtained in the same manner as described for the image print [8] according to Comparative example 3 employing the recycling developer [1-3]. No difference in the image quality was observed in a visual observation between the initial image print [8] and the image print [8-2].

Comparative Example 4

On a "3 paper" produced by Konica Minolta Business Solutions, Inc., a toner image formed by BIZHUB C 253 (produced by Konica Minolta Business Technologies, Inc.) from which the fixing device was removed, employing developer [2] was transferred, and then a CELLOTAPE® CT-15S (produced by NICHIBAN Co., Ltd.) was laminated. The obtained sheet was passed through the removed fixing device without using the heating member to obtain an image print [9] in which a toner holding layer holding a toner image is provided on a paper.

The fixing ratios on this image print [9] determined via the mending tape exfoliating method and the cloth rubbing method were calculated in the same manner as described in Example 1. From the results, the fixing of the toner image and a high fixing strength of the image were confirmed.

When the CELLOTAPE® was exfoliated from the paper, it was found that a part of the toner particles were left on the paper ant it was impossible to recover all the toner particles. Further, it was confirmed that a part of the paper was exfoliated.

The electric energies necessary to obtain each of the image prints of Examples 1-5 and Comparative examples 1-4, the "possible" or "impossible" to recycle toner particles and the image supporting substrate and the results of the evaluation of the fixing strength were listed in Table 1.

TABLE 1

| | Evaluation | | | | |
|---|---|---|---|---|---|
| | Fixing strength | | | | |
| | Mending | | | Recycling | |
| | Electric energy (Wh) | tape exfoliation method | Cloth rubbing method | Toner particles | Image supporting substrate |
| Example 1 | 0.032 | A | A | Possible | Possible |
| Example 2 | 0.064 | A | A | Possible | Possible |

TABLE 1-continued

| | Evaluation | | | | |
|---|---|---|---|---|---|
| | Fixing strength | | | | |
| | Mending | | | Recycling | |
| | Electric energy (Wh) | tape exfoliation method | Cloth rubbing method | Toner particles | Image supporting substrate |
| Example 3 | 0.006 | A | A | Possible | Possible |
| Example 4 | 0.032 | A | A | Possible | Possible |
| Example 5 | 0.064 | A | A | Possible | Possible |
| Comparative example 1 | 0.225 | A | A | Impossible | Impossible |
| Comparative example 2 | 0.225 | A | A | Impossible | Possible |
| Comparative example 3 | 0 | A | B | Possible | Possible |
| Comparative example 4 | 0.032 | A | A | Impossible | Impossible |

What is claimed is:

1. An image forming method comprising the step of:

forming a toner image employing toner particles containing at least a resin on an image supporting substrate having thereon a toner holding layer via a toner image holding process to form an image print, the toner image being held in the toner holding layer in the toner image holding process, wherein at least the toner particles or the image supporting substrate is separated from the image print via a separation process; and at least the separated toner particles or the separated image supporting substrate is recyclable as an image forming material, wherein the separation process is carried out by separating the image print into the supporting substrate and the toner holding layer holding the toner image, followed by immersing the toner holding layer in a separation liquid, the separation liquid dissolving or swelling a material constituting the toner holding layer, but not dissolving the toner particles.

2. The image forming method of claim 1, wherein the image forming material is recyclable in the image forming method of claim 1.

3. The image forming method of claim 1, wherein the image supporting substrate comprises a standard paper, a high-quality paper, an art paper, a coat paper, a Japanese paper, a post card paper, a polypropylen synthetic paper, a polyethylene terephthalate film, a polyethylenenaphthalate film, a polyimide film or a cloth.

4. The image forming method of claim 1, wherein a penetration of the toner holding layer is 30-300, the penetration being defined in JIS K2207.

5. The image forming method of claim 1, wherein the toner holding layer comprises a resin or a water soluble polymer.

6. The image forming method of claim 1, wherein the toner particles are buried in the toner holding layer with an external force in the range of $1.00\times10^3$-$1.00\times10^3$ Pa in the toner image holding process.

7. The image forming method of claim 1 further comprising the step of providing a surface protective layer on the toner holding layer.

8. A method of recycling an image forming material comprising the steps of:

forming a toner image employing toner particles containing at least a resin on an image supporting substrate having thereon a toner holding layer via a toner image holding process to form an image print, the toner image being held in the toner holding layer in the toner image holding process, separating at least the toner particles or the image supporting substrate from the image print via a separation process; and recycling at least the separated toner particles or the separated image supporting substrate as the image forming material, wherein the separation process is carried out by separating the image print into the image supporting substrate and the toner holding layer, followed by immersing the toner holding layer in a separation liquid, the separation liquid dissolving or swelling a material constituting the toner holding layer, but not dissolving the toner particles.

9. The method of claim 8 further comprising the step of:

adding an external additive to the toner particles separated in the separation process to prepare the toner for recycling.

* * * * *